US009484010B2

(12) United States Patent
Nohara et al.

(10) Patent No.: US 9,484,010 B2
(45) Date of Patent: Nov. 1, 2016

(54) ACTIVE VIBRATION NOISE CONTROL DEVICE, ACTIVE VIBRATION NOISE CONTROL METHOD AND ACTIVE VIBRATION NOISE CONTROL PROGRAM

(75) Inventors: Manabu Nohara, Tsurugashima (JP); Yoshiki Ohta, Sakado (JP); Kensaku Obata, Kawasaki (JP); Yusuke Soga, Kawasaki (JP)

(73) Assignee: PIONEER CORPORATION, Kanagawa (JP)

( * ) Notice: Subject to any disclaimer, the term of this patent is extended or adjusted under 35 U.S.C. 154(b) by 366 days.

(21) Appl. No.: 13/977,253

(22) PCT Filed: Jan. 6, 2011

(86) PCT No.: PCT/JP2011/050079

§ 371 (c)(1),
(2), (4) Date: Jun. 28, 2013

(87) PCT Pub. No.: WO2012/093477

PCT Pub. Date: Jul. 12, 2012

(65) Prior Publication Data

US 2013/0279712 A1 Oct. 24, 2013

(51) Int. Cl.
*G10K 11/178* (2006.01)

(52) U.S. Cl.
CPC ..... *G10K 11/178* (2013.01); *G10K 11/1786* (2013.01); *G10K 2210/1282* (2013.01); *G10K 2210/3023* (2013.01); *G10K 2210/3028* (2013.01)

(58) Field of Classification Search
CPC ..... G10K 11/178; G10K 11/1786; G10K 2210/1282; G10K 2210/3023; G10K 2210/3028
USPC ..... 381/71.1, 71.4, 71.11, 71.12
See application file for complete search history.

(56) References Cited

U.S. PATENT DOCUMENTS 5,384,853 A * 1/1995 Kinoshita et al. ..... 381/71.12
2004/0247137 A1 12/2004 Inoue et al.

(Continued)

FOREIGN PATENT DOCUMENTS

| | | |
|---|---|---|
| JP | 6-019485 | 1/1994 |
| JP | 6-035485 | 2/1994 |
| JP | 7-230289 | 8/1995 |
| JP | 8-006573 | 1/1996 |

(Continued)

OTHER PUBLICATIONS

International Search Report, PCT/JP2011/050079, Mar. 1, 2011.

*Primary Examiner* — Davetta W Goins
*Assistant Examiner* — Daniel Sellers
(74) *Attorney, Agent, or Firm* — Young & Thompson

(57) ABSTRACT

An active vibration noise control device obtains error signals corresponding to a cancellation error between vibration noise and control sounds generated by multiple speakers, from microphone(s), and actively controls the vibration noise. A basic signal generating unit generates a basic signal based on a vibration noise frequency. An adaptive notch filter unit generates control signals provided to each of the multiple speakers by applying a filter coefficient to the basic signal. A reference signal generating unit generates a reference signal from the basic signal based on multiple transfer characteristics from the multiple speakers to the one or more microphones. A filter coefficient updating unit updates the filter coefficient used by the adaptive notch filter unit so as to minimize the error signals. A controlling unit changes amplitude of the control signals of the speakers based on a similarity between the transfer characteristics and characteristics of the vibration noise.

22 Claims, 13 Drawing Sheets

(56) References Cited

U.S. PATENT DOCUMENTS

| | | | | |
|---|---|---|---|---|
| 2007/0172004 | A1* | 7/2007 | Funayama et al. | 375/346 |
| 2008/0181422 | A1* | 7/2008 | Christoph | 381/73.1 |
| 2009/0279710 | A1 | 11/2009 | Onishi et al. | |
| 2010/0027805 | A1* | 2/2010 | Itou et al. | 381/71.12 |
| 2012/0033821 | A1 | 2/2012 | Ohta et al. | |

FOREIGN PATENT DOCUMENTS

| | | |
|---|---|---|
| JP | 2000-099037 | 4/2000 |
| JP | 3843082 | 8/2006 |
| JP | 2008-213755 | 9/2008 |
| WO | WO 2007/011010 | 1/2007 |
| WO | WO 2010/119528 | 10/2010 |

* cited by examiner

ACTIVE VIBRATION NOISE CONTROL DEVICE, ACTIVE VIBRATION NOISE CONTROL METHOD AND ACTIVE VIBRATION NOISE CONTROL PROGRAM

TECHNICAL FIELD

The present invention relates to a technical field for actively controlling a vibration noise by using an adaptive notch filter.

BACKGROUND TECHNIQUE

Conventionally, there is proposed an active vibration noise control device for controlling an engine noise heard in a vehicle interior by a controlled sound output from a speaker so as to decrease the engine noise at a position of passenger's ear. For example, noticing that a vibration noise in a vehicle interior is generated in synchronization with a revolution of an output axis of an engine, there is proposed a technique for canceling the noise in the vehicle interior on the basis of the revolution of the output axis of the engine by using an adaptive notch filter so that the vehicle interior becomes silent.

By the way, in a narrow vehicle interior environment, there is a case that a deep dip of transfer characteristics from a speaker to a microphone occurs due to a sound wave interference and a reflection in a vehicle interior space. In such a frequency band that the deep dip occurs, an operation of the adaptive notch filter tends to become unstable, and a noise-canceling effect tends to decrease.

For example, in Patent References 1 and 2, there is proposed a technique for solving the above problem. In Patent Reference-1, there is proposed a technique for increasing a gain applied to transfer characteristics. In Patent Reference-2, there is proposed a technique for using multiple speakers, and for switching a speaker to be used in accordance with a noise frequency. Concretely, the technique verifies transfer characteristics of paths related to the multiple speakers, and selects a path of speaker in which an influence of the dip is small (in other words, a speaker to which the largest gain is applied).

PRIOR ART REFERENCE

Patent Reference

Patent Reference-1: Japanese Patent No. 3843082

Patent Reference-2: International Patent Application Laid-open under No. 2007-011010

SUMMARY OF INVENTION

Problem to be Solved by the Invention

Though the technique described in Patent Reference-1 increases the gain applied to the transfer characteristics when the dip of the transfer characteristics from the speaker to the microphone occurs, there is a problem that a noise-canceling effect is relatively low. In order to solving the problem, the technique described in Patent Reference-2 verifies the transfer characteristics of the paths related to the multiple speakers, and selects the path of the speaker to which the largest gain is applied. Therefore, the technique described in Patent Reference-2 realizes a higher noise-canceling effect than the technique described in Patent Reference-1.

However, the active vibration noise control devices described in Patent References 1 and 2 perform the control only based on the transfer characteristics from the speaker to the microphone without considering characteristics of the vibration noise. Therefore, there is a problem that the noise-canceling effect decreases depending on the characteristics of the vibration noise. For example, when there is a dip of the characteristics of the vibration noise, i.e., when sound pressure characteristics significantly decrease, the noise-canceling effect by the active vibration noise control device decreases.

The present invention has been achieved in order to solve the above problem. It is an object of the present invention to provide an active vibration noise control device, an active vibration noise control method and an active vibration noise control program, capable of appropriately ensuring a noise-canceling effect by considering not only transfer characteristics from a speaker to a microphone but also characteristics of a vibration noise.

Means for Solving the Problem

The invention according to claim 1 is an active vibration noise control device which obtains error signals corresponding to a cancellation error between a vibration noise and control sounds generated by multiple speakers, from at least one or more microphones, and which actively controls the vibration noise. The active vibration noise control device, includes: a basic signal generating unit which generates a basic signal based on a vibration noise frequency of the vibration noise; an adaptive notch filter unit which generates control signals provided to each of the multiple speakers by applying a filter coefficient to the basic signal, in order to make the multiple speakers generate the control sounds so that the vibration noise is canceled; a reference signal generating unit which generates a reference signal from the basic signal based on multiple transfer characteristics from the multiple speakers to the one or more microphones; a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a similarity degree between each of the multiple transfer characteristics and characteristics of the vibration noise.

The invention according to claim 13 is an active vibration noise control method executed by a device which obtains error signals corresponding to a cancellation error between a vibration noise and control sounds generated by multiple speakers, from at least one or more microphones, and which actively controls the vibration noise. The active vibration noise control method, includes: a basic signal generating process which generates a basic signal based on a vibration noise frequency of the vibration noise; an adaptive notch filter process which generates control signals provided to each of the multiple speakers by applying a filter coefficient to the basic signal, in order to make the multiple speakers generate the control sounds so that the vibration noise is canceled; a reference signal generating process which generates a reference signal from the basic signal based on multiple transfer characteristics from the multiple speakers to the one or more microphones; a filter coefficient updating process which updates the filter coefficient used by the adaptive notch filter process based on the reference signal and the error signals detected by the one or more microphones so as to minimize the error signals; and a controlling process which changes amplitude of the control signals of the multiple speakers based on a similarity degree between each of the multiple transfer characteristics and characteristics of the vibration noise.

The invention according to claim 14 is an active vibration noise control program executed by a device which obtains error signals corresponding to a cancellation error between a vibration noise and control sounds generated by multiple speakers, from at least one or more microphones, and which actively controls the vibration noise, and which includes a computer. The active vibration noise control program makes the computer function as: a basic signal generating unit which generates a basic signal based on a vibration noise frequency of the vibration noise; an adaptive notch filter unit which generates control signals provided to each of the multiple speakers by applying a filter coefficient to the basic signal, in order to make the multiple speakers generate the control sounds so that the vibration noise is canceled; a reference signal generating unit which generates a reference signal from the basic signal based on multiple transfer characteristics from the multiple speakers to the one or more microphones; a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a similarity degree between each of the multiple transfer characteristics and characteristics of the vibration noise.

MODE TO EXERCISE THE INVENTION

Figure 1:
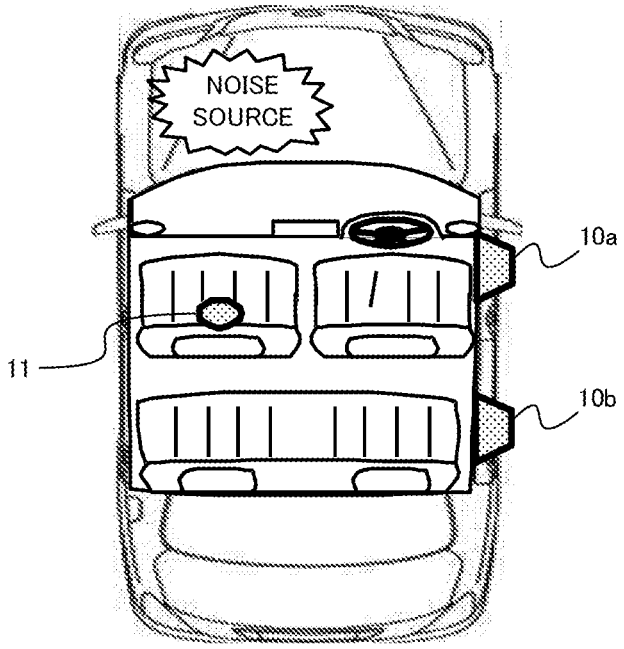
FIG. 1 shows an example of a vehicle on which an active vibration noise control device is mounted.

According to one aspect of the present invention, there is provided an active vibration noise control device which obtains error signals corresponding to a cancellation error between a vibration noise and control sounds generated by multiple speakers, from at least one or more microphones, and which actively controls the vibration noise, including: a basic signal generating unit which generates a basic signal based on a vibration noise frequency of the vibration noise; an adaptive notch filter unit which generates control signals provided to each of the multiple speakers by applying a filter coefficient to the basic signal, in order to make the multiple speakers generate the control sounds so that the vibration noise is canceled; a reference signal generating unit which generates a reference signal from the basic signal based on multiple transfer characteristics from the multiple speakers to the one or more microphones; a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a similarity degree between each of the multiple transfer characteristics and characteristics of the vibration noise.

The above active vibration noise control device obtains the error signals corresponding to the cancellation error between the vibration noise and the control sounds generated by the multiple speakers, from at least one or more microphones, and actively controls the vibration noise (for example, a vibration noise from an engine). The basic signal generating unit generates the basic signal based on the vibration noise frequency of the vibration noise. The adaptive notch filter unit generates the control signals provided to each of the multiple speakers by applying the filter coefficient to the basic signal. The reference signal generating unit generates the reference signal from the basic signal based on the multiple transfer characteristics from each of the multiple speakers to the one or more microphones. The filter coefficient updating unit updates the filter coefficient used by the adaptive notch filter unit so as to minimize the error signals. Then, the controlling unit changes the amplitude of the control signals of the multiple speakers based on the similarity degree between each of the multiple transfer characteristics and the characteristics of the vibration noise. Here, "similarity degree" is a value indicating a degree of similarity between each of the multiple transfer characteristics and characteristics of the vibration noise. Additionally, "characteristics of vibration noise" correspond to sound pressure characteristics and/or phase characteristics from a vibration noise source to the microphone.

By the above active vibration noise device, it is possible to appropriately perform the active noise control in consideration of both the transfer characteristics from the speaker to the microphone and the characteristics of the vibration noise. Therefore, it becomes possible to ensure the noise-canceling effect regardless of the characteristics of the vibration noise.

In one mode of the above active vibration noise control device, as the similarity degree becomes higher, the controlling unit makes the amplitude of the control signals larger. Therefore, it is possible to effectively generate the control sound from such a speaker that the similarity degree is high. Hence, it becomes possible to appropriately ensure the noise-canceling effect regardless of the characteristics of the vibration noise.

In another mode of the above active vibration noise control device, the controlling unit includes a step-size parameter changing unit which changes the amplitude of the control signals by changing a step-size parameter used for updating the filter coefficient in the filter coefficient updating unit, based on the similarity degree. In the mode, the control signal can be changed to desired amplitude by changing the step-size parameter based on the similarity degree.

In another mode of the above active vibration noise control device, as for a speaker having such transfer characteristics that the similarity degree is highest in the multiple transfer characteristics, the step-size parameter changing unit does not change the step-size parameter for updating the filter coefficient used by the adaptive notch filter unit which generates the control signal of the said speaker. As for one or more speakers other than the speaker having such transfer characteristics that the similarity degree is highest, the step-size parameter changing unit changes the step-size parameter for updating the filter coefficient used by the adaptive notch filter unit which generates the control signals of the said one or more speakers, to "0".

In the mode, it is possible to generate the control sound from only the speaker having such transfer characteristics that the similarity degree is highest. Namely, it is possible to stop generating the control sound from the speaker having such transfer characteristics that the similarity degree is less high (i.e., one or more speakers except for the speaker having such transfer characteristics that the similarity degree is highest). Therefore, it becomes possible to appropriately ensure the noise-canceling effect regardless of the characteristics of the vibration noise.

In another mode of the above active vibration noise control device, the step-size parameter changing unit makes the step-size parameter larger as the similarity degree becomes higher, and the step-size parameter changing unit makes the step-size parameter smaller as the similarity degree becomes lower.

In the mode, the control sound can be effectively generated from the speaker having the transfer characteristics which is similar to the characteristics of the vibration noise, and the generation of the control sound from the speaker having the transfer characteristics which is less similar to the characteristics of the vibration noise can be appropriately suppressed. Therefore, it becomes possible to certainly ensure the noise-canceling effect regardless of the characteristics of the vibration noise.

In another mode of the above active vibration noise control device, the controlling unit includes an amplifying unit which amplifies the control signals generated by the adaptive notch filter unit, and outputs the amplified control signals to the multiple speakers, and the controlling unit includes a gain changing unit which changes the amplitude of the control signals by changing a gain used by the amplifying unit, based on the similarity degree. In the mode, the control signal can be changed to desired amplitude by changing the gain based on the similarity degree.

In another mode of the above active vibration noise control device, as for a speaker having such transfer characteristics that the similarity degree is highest in the multiple transfer characteristics, the gain changing unit does not change the gain used by the amplifying unit which amplifies the control signal of the said speaker. As for one or more speakers other than the speaker having such transfer characteristics that the similarity degree is highest, the gain changing unit changes the gain used by the amplifying unit which amplifies the control signals of the said one or more speakers, to "0".

In the mode, it is possible to generate the control sound from only the speaker having such transfer characteristics that the similarity degree is highest. Namely, it is possible to stop generating the control sound from the speaker having such transfer characteristics that the similarity degree is less high (i.e., one or more speakers except for the speaker having such transfer characteristics that the similarity degree is highest). Therefore, it becomes possible to appropriately ensure the noise-canceling effect regardless of the characteristics of the vibration noise.

In another mode of the above active vibration noise control device, the gain changing unit makes the step-size parameter larger as the similarity degree becomes higher, and the gain changing unit makes the step-size parameter smaller as the similarity degree becomes lower.

In the mode, the control sound can be effectively generated from the speaker having the transfer characteristics which is similar to the characteristics of the vibration noise, and the generation of the control sound from the speaker having the transfer characteristics which is less similar to the characteristics of the vibration noise can be appropriately suppressed. Therefore, it becomes possible to certainly ensure the noise-canceling effect regardless of the characteristics of the vibration noise.

In another mode of the above active vibration noise control device, the controlling unit changes the amplitude of the control signals only when the vibration noise frequency is within a frequency band in which a dip of the vibration noise occurs, and the controlling unit does not change the amplitude of the control signals when the vibration noise frequency is not within the frequency band. Therefore, it is possible to appropriately suppress the decrease in the noise-canceling effect within the frequency band in which the dip of the vibration noise occurs.

In a preferred example, the similarity degree is defined based on gain characteristics of the multiple transfer characteristics and sound pressure characteristics of the vibration noise.

In another preferred example, the similarity degree is defined based on phase characteristics of the multiple transfer characteristics and phase characteristics of the vibration noise.

In still another preferred example, normalized cross-correlation between each of the multiple transfer characteristics and characteristics of the vibration noise is used as the similarity degree.

According to another aspect of the present invention, there is provided an active vibration noise control method executed by a device which obtains error signals corresponding to a cancellation error between a vibration noise and control sounds generated by multiple speakers, from at least one or more microphones, and which actively controls the vibration noise, including: a basic signal generating process which generates a basic signal based on a vibration noise frequency of the vibration noise; an adaptive notch filter process which generates control signals provided to each of the multiple speakers by applying a filter coefficient to the basic signal, in order to make the multiple speakers generate the control sounds so that the vibration noise is canceled; a reference signal generating process which generates a reference signal from the basic signal based on multiple transfer characteristics from the multiple speakers to the one or more microphones; a filter coefficient updating process which updates the filter coefficient used by the adaptive notch filter process based on the reference signal and the error signals detected by the one or more microphones so as to minimize the error signals; and a controlling process which changes amplitude of the control signals of the multiple speakers based on a similarity degree between each of the multiple transfer characteristics and characteristics of the vibration noise.

According to still another aspect of the present invention, there is provided an active vibration noise control program executed by a device which obtains error signals corresponding to a cancellation error between a vibration noise and control sounds generated by multiple speakers, from at least one or more microphones, and which actively controls the vibration noise, and which includes a computer, the program makes the computer function as: a basic signal generating unit which generates a basic signal based on a vibration noise frequency of the vibration noise; an adaptive notch filter unit which generates control signals provided to each of the multiple speakers by applying a filter coefficient to the basic signal, in order to make the multiple speakers generate the control sounds so that the vibration noise is canceled; a reference signal generating unit which generates a reference signal from the basic signal based on multiple transfer characteristics from the multiple speakers to the one or more microphones; a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a similarity degree between each of the multiple transfer characteristics and characteristics of the vibration noise.

Also by the active vibration noise control method and the active vibration noise control program, it becomes possible to ensure the noise-canceling effect regardless of the characteristics of the vibration noise.

Embodiment

The preferred embodiments of the present invention will now be described below with reference to the drawings.

[Basic Concept]

A problem of the above-mentioned active vibration noise control device according to Patent Reference-2 (hereinafter referred to as "active vibration noise control device according to comparative example") will be firstly described, and then a basic concept of this embodiment intended to solve the said problem will be described. The active vibration noise control device according to the comparative example verifies the transfer characteristics of the paths related to the multiple speakers, and selects the path of the speaker in which the influence of the dip is smallest (in other words, the speaker to which the largest gain is applied).

Here, an active vibration noise control device having two speakers 10*a* and 10*b* and a microphone 11 as shown in FIG. 1 will be explained as an example. The active vibration noise control device is mounted on a vehicle. The speaker 10*a* is installed on a front side in the vehicle. The speaker 10*b* is installed on a rear side in the vehicle. The microphone 11 is installed on a passenger's side. Hereinafter, when the speaker 10*a* is not distinguished from the speaker 10*b*, the speakers 10*a* and 10*b* are represented as "speaker 10".

The active vibration noise control device makes the speakers 10*a* and 10*b* generate control sounds based on a frequency in accordance with a revolution of an engine output axis, so as to actively control a vibration noise of the engine as a vibration noise source. Namely, the active vibration noise control device performs so-called "active noise control (ANC)". Concretely, the active vibration noise control device feeds back an error signal detected by the microphone 11 and minimizes an error by using an adaptive notch filter so as to actively control the vibration noise.

Figure 2A:
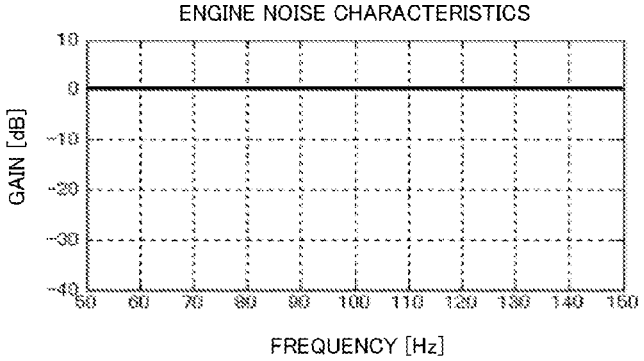
FIGS. 2A to 2D show result examples by an active vibration noise control device according to a comparative example.
Figure 2B:
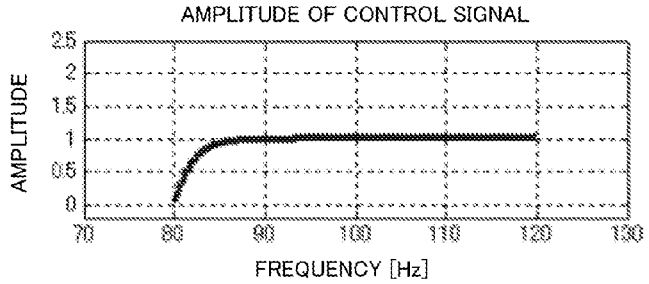
Figure 2C:
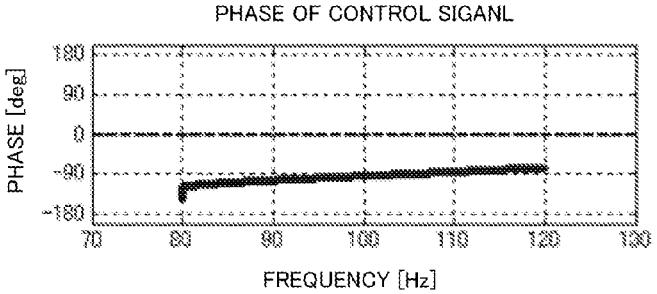
Figure 2D:
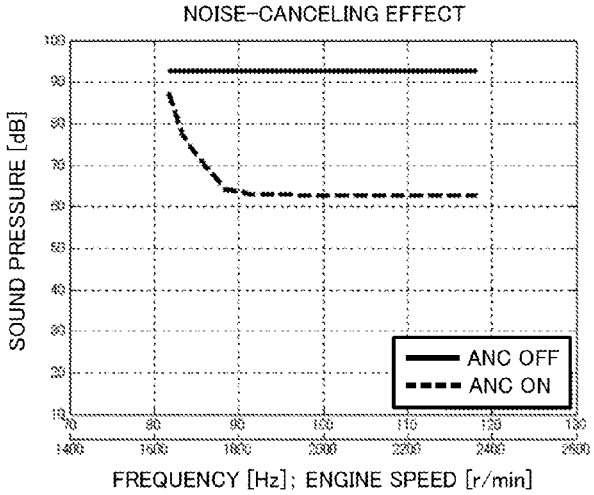

FIGS. 2A to 2D show result examples by the active vibration noise control device according to the comparative example. Here, the results obtained when the engine noise has characteristics shown in FIG. 2A (concretely, when a gain of the engine noise is flat with respect to the frequency) are shown. FIG. 2B shows amplitude of the control signal by the active vibration noise control device according to the comparative example, and FIG. 2C shows phase of the control signal by the active vibration noise control device according to the comparative example. Additionally, FIG. 2D shows a noise-canceling effect by the active vibration noise control device according to the comparative example. In FIG. 2D, a horizontal axis shows a frequency and engine speed, and a vertical axis shows a sound pressure detected by the microphone 11. In addition, a solid line shows a graph obtained when the active noise control is not performed (ANC OFF), and a broken line shows a graph obtained when the active noise control is performed (ANC ON). As shown in FIG. 2D, it can be understood that the engine noise is appropriately canceled by the active vibration noise control device according to the comparative example.

Figure 3A:
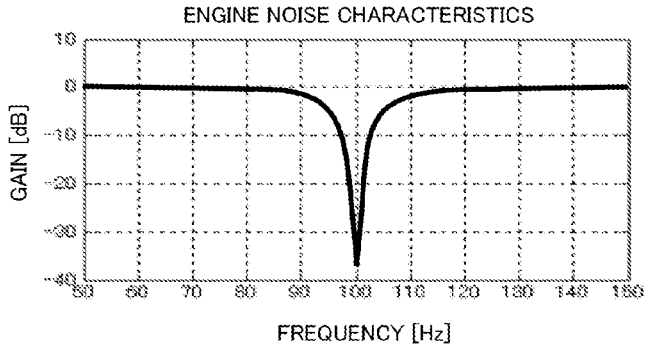
FIGS. 3A to 3D show other result examples by an active vibration noise control device according to a comparative example.
Figure 3B:
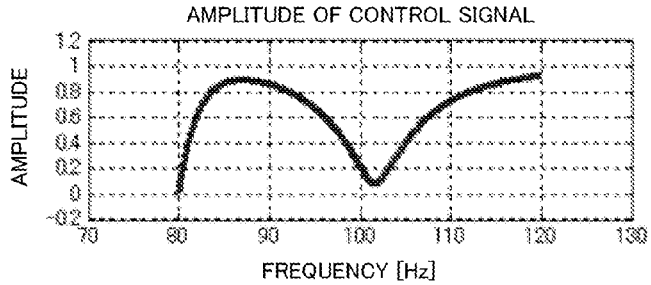
Figure 3C:
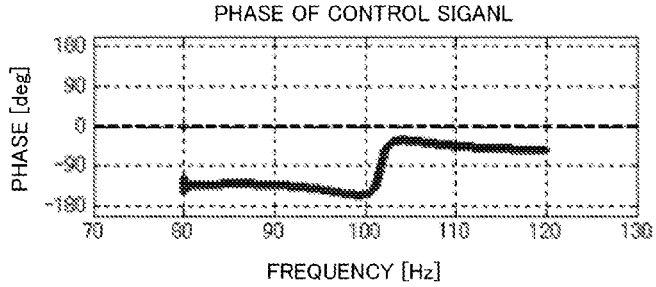
Figure 3D:
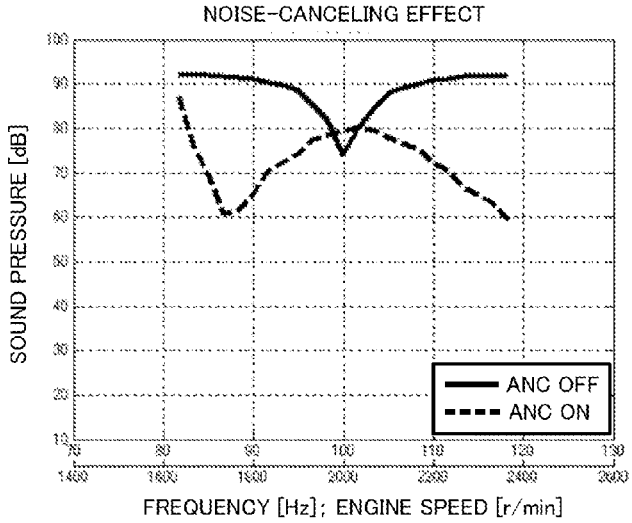

FIGS. 3A to 3D show other result examples by the active vibration noise control device according to the comparative example. Here, the results obtained when the engine noise has characteristics shown in FIG. 3A (concretely, when there is the dip of the characteristics of the engine noise) are shown. FIG. 3B shows amplitude of the control signal by the active vibration noise control device according to the comparative example, and FIG. 3C shows phase of the control signal by the active vibration noise control device according to the comparative example. As shown in FIGS. 3B and 3C, it can be understood that the control signal becomes unstable within a frequency band in which the dip of the characteristics of the engine noise occurs. FIG. 3D shows a noise-canceling effect by the active vibration noise control device according to the comparative example. In FIG. 3D, a horizontal axis shows a frequency and engine speed, and a vertical axis shows a sound pressure detected by the microphone 11. Additionally, a solid line shows a graph obtained when the active noise control is not performed (ANC OFF), and a broken line shows a graph obtained when the active noise control is performed (ANC ON). As shown in FIG. 3D, it can be understood that the engine noise is not appropriately canceled by the active vibration noise control device according to the comparative example. Specifically, it can be understood that noise-canceled amount decreases within the frequency band in which the dip of the characteristics of the engine noise occurs.

Thus, by the active vibration noise control device according to the comparative example, though it is possible to appropriately cancel the engine noise when there is not the dip of the characteristics of the engine noise, it is not possible to appropriately cancel the engine noise when there is the dip of the characteristics of the engine noise. This is because the active vibration noise control device according to the comparative example performs the control only based on the transfer characteristics from the speaker 10 to the microphone 11 without considering the characteristics of the vibration noise.

Therefore, the embodiment performs the active noise control by considering not only the transfer characteristics from the speaker 10 to the microphone 11 but also the characteristics of the engine noise, in order to solve the above problem. Concretely, the active vibration noise control device according to the embodiment performs the active noise control based on a similarity degree between the transfer characteristics from the speaker 10 to the microphone 11 and the characteristics of the engine noise. Specifically, the active vibration noise control device according to the embodiment changes the amplitude of the control signal provided to the speaker 10, based on the similarity degree. The detail of the said control will be described in first to third embodiments. In the specification, "characteristics of engine noise" means sound pressure characteristics and/or phase characteristics from the engine to the microphone.

First Embodiment

First, a description will be given of a first embodiment in the present invention. The first embodiment selects the speaker 10 generating the control sound based on the similarity degree between the transfer characteristics from the speaker 10 to the microphone 11 and the characteristics of the engine noise. Concretely, the first embodiment selects the speaker 10 having such transfer characteristics that the similarity degree is highest. Then, the first embodiment makes the said speaker 10 generate the control sound, and does not make the other speaker 10 generate the control sound. The first embodiment realizes the above control by changing a step-size parameter for updating a filter coefficient used by the adaptive notch filter. Specifically, as for the speaker 10 having such transfer characteristics that the similarity degree is highest, the first embodiment does not change the step-size parameter. Meanwhile, as for the other speaker 10, the first embodiment changes the step-size parameter to "0". Therefore, the speaker 10 for which the step-size parameter is changed to "0" does not generate the control sound. In this case, the amplitude of the control signal is substantiality "0". Meanwhile, only the speaker 10 for which the step-size parameter is not changed (i.e., the speaker 10 having such transfer characteristics that the similarity degree is highest) generates the control sound.

(Device Configuration)

Figure 4:
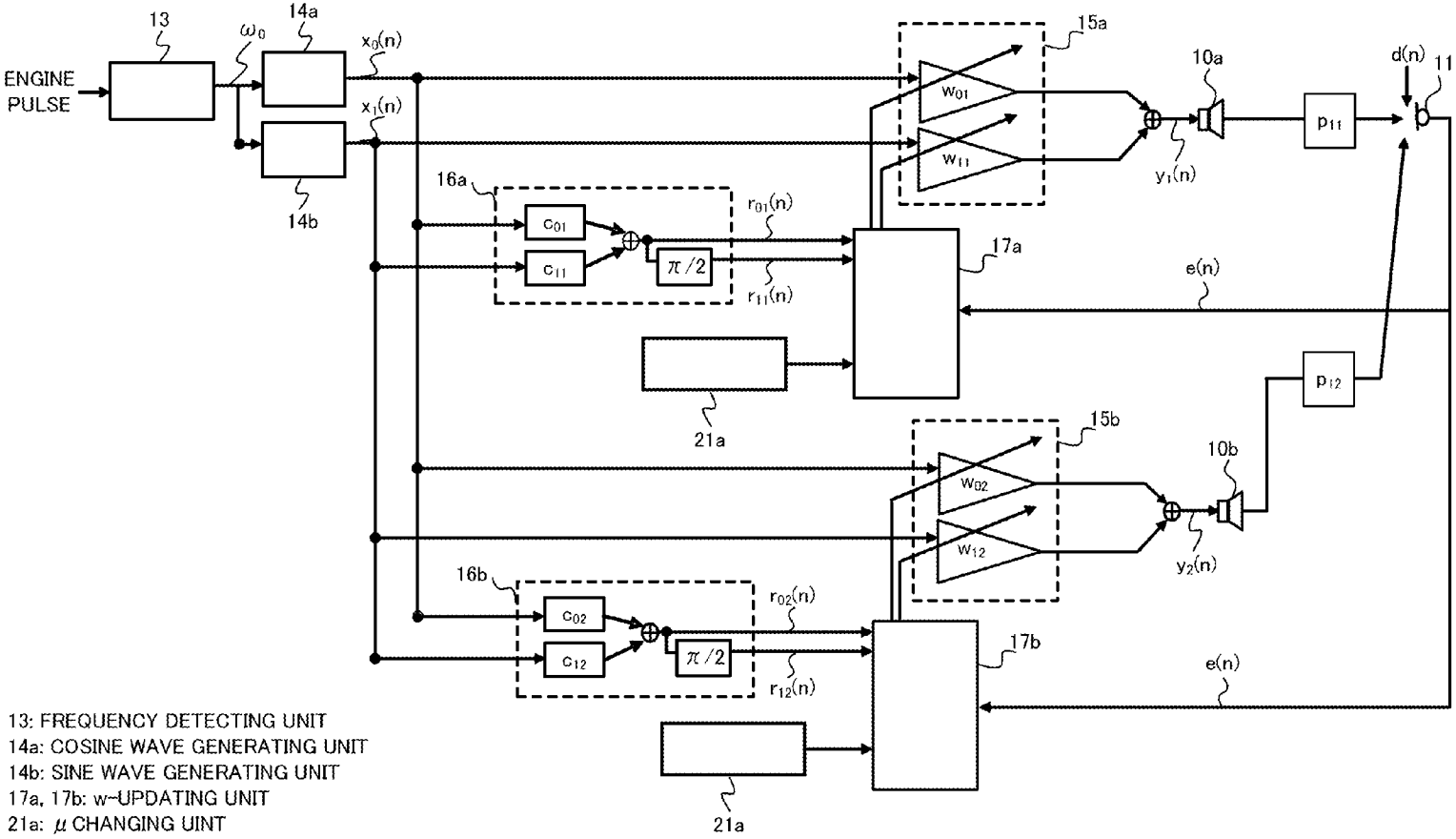
FIG. 4 shows a block diagram of an active vibration noise control device according to a first embodiment.

Next, a description will be given of a concrete configuration of an active vibration noise control device 50 in the first embodiment, with reference to FIG. 4. FIG. 4 is a block diagram showing an example of the configuration of the active vibration noise control device 50 according to the first embodiment.

The active vibration noise control device 50 according to the first embodiment includes speakers 10*a* and 10*b*, a microphone 11, a frequency detecting unit 13, a cosine wave generating unit 14*a*, a sine wave generating unit 14*b*, adaptive notch filters 15*a* and 15*b*, reference signal generating units 16*a* and 16*b*, w-updating units 17*a* and 17*b*, and μ changing units 21*a* and 21*b*.

The active vibration noise control device 50 is mounted on the vehicle as shown in FIG. 1. The speaker 10*a* is installed on the front side in the vehicle. The speaker 10*b* is installed on the rear side in the vehicle. The microphone 11 is installed on the passenger's side. Hereinafter, as for the speakers 10*a* and 10*b*, the adaptive notch filters 15*a* and 15*b*, the reference signal generating units 16*a* and 16*b*, the w-updating units 17*a* and 17*b*, and the μ changing units 21*a* and 21*b*, "a" and "b" which are applied to the reference numeral are suitably omitted. It is not necessary that the active vibration noise control device 50 is configured to include the speaker 10 and the microphone 11. A system having components except for the speaker 10 and the microphone 11 may be treated as the active vibration noise control device 50. The same will apply hereinafter.

The frequency detecting unit 13 is supplied with an engine pulse and detects a frequency $\omega_0$ of the engine pulse. Then, the frequency detecting unit 13 supplies the cosine wave generating unit 14*a* and the sine wave generating unit 14*b* with a signal corresponding to the frequency $\omega_0$.

The cosine wave generating unit 14*a* and the sine wave generating unit 14*b* generate a basic cosine wave $x_0(n)$ and a basic sine wave $x_1(n)$ which include the frequency $\omega_0$ detected by the frequency detecting unit 13. Concretely, as shown by equations (1) and (2), the cosine wave generating unit 14*a* and the sine wave generating unit 14*b* generate the basic cosine wave $x_0(n)$ and the basic sine wave $x_1(n)$. In the equations (1) and (2), "n" is natural number and corresponds to time (The same will apply hereinafter). Additionally, "A" indicates amplitude, and "φ" indicates an initial phase.

$$x_0(n)=A\cos(\omega_0 n+\phi) \tag{1}$$

$$x_1(n)=A\sin(\omega_0 n+\phi) \tag{2}$$

Then, the cosine wave generating unit 14*a* and the sine wave generating unit 14*b* supply the adaptive notch filter 15 and the reference signal generating unit 16 with basic signals corresponding to the basic cosine wave $x_0(n)$ and the basic sine wave $x_1(n)$. Thus, the cosine wave generating unit 14*a* and the sine wave generating unit 14*b* correspond to an example of the basic signal generating unit.

The adaptive notch filters 15*a* and 15*b* perform the filter process of the basic cosine wave $x_0(n)$ and the basic sine wave $x_1(n)$, so as to generate the control signals $y_1(n)$ and $y_2(n)$ supplied to the speakers 10*a* and 10*b*. Concretely, the adaptive notch filter 15*a* generates the control signal $y_1(n)$ based on the filter coefficients $w_{01}(n)$ and $w_{11}(n)$ inputted from the w-updating unit 17*a*, and the adaptive notch filter 15*b* generates the control signal $y_2(n)$ based on the filter coefficients $w_{02}(n)$ and $w_{12}(n)$ inputted from the w-updating unit 17*b*. Specifically, as shown by an equation (3), the adaptive notch filter 15*a* adds a value obtained by multiplying the basic cosine wave $x_0(n)$ by the filter coefficient $w_{01}(n)$, to a value by multiplying the basic sine wave $x_1(n)$ by the filter coefficient $w_{11}(n)$, so as to calculate the control signal $y_1(n)$. Similarly, as shown by an equation (4), the adaptive notch filter 15*b* adds a value obtained by multiplying the basic cosine wave $x_0(n)$ by the filter coefficient $w_{02}(n)$, to a value by multiplying the basic sine wave $x_1(n)$ by the filter coefficient $w_{12}(n)$, so as to calculate the control signal $y_2(n)$. Thus, the adaptive notch filters 15*a* and 15*b* correspond to an example of the adaptive notch filter unit.

$$y_1(n)=w_{01}(n)x_0(n)+w_{11}(n)x_1(n) \tag{3}$$

$$y_2(n)=w_{02}(n)x_0(n)+w_{12}(n)x_1(n) \tag{4}$$

The speakers 10*a* and 10*b* generate the control sounds corresponding to the control signals $y_1(n)$ and $y_2(n)$ inputted from the adaptive notch filters 15*a* and 15*b*, respectively. The control sounds generated by the speakers 10*a* and 10*b* are transferred to the microphone 11. Transfer characteristics from the speakers 10*a* and 10*b* to the microphone 11 are represented by "$p_{11}$" and "$p_{12}$", respectively. The transfer characteristics $p_{11}$ and $p_{12}$ correspond to a function (transfer function) defined by the frequency $\omega_0$, and depend on sound field characteristics and the distance from the speakers 10*a* and 10*b* to the microphone 11. For example, the transfer characteristics $p_{11}$ and $p_{12}$ are preliminarily set by a measurement in the vehicle interior.

The microphone 11 detects a cancellation error between the vibration noise of the engine and the control sounds generated by the speakers 10*a* and 10*b*, and supplies the w-updating units 17*a* and 17*b* with the cancellation error as the error signal e(n). Concretely, the microphone 11 outputs the error signal e(n) in accordance with the control signals $y_1(n)$ and $y_2(n)$, the transfer characteristics $p_{11}$ and $p_{12}$ and the vibration noise d(n).

The reference signal generating units 16*a* and 16*b* generate reference signals from the basic cosine wave $x_0(n)$ and the basic sine wave $x_1(n)$ based on the above transfer characteristics $p_{11}$ and $p_{12}$, and supply the w-updating units 17*a* and 17*b* with the reference signals. Concretely, the reference signal generating unit 16*a* uses a real part $c_{01}$ and an imaginary part $c_{11}$ of the transfer characteristics $p_{11}$, and the reference signal generating unit 16*b* uses a real part $c_{02}$ and an imaginary part $c_{12}$ of the transfer characteristics $p_{12}$. Specifically, the reference signal generating unit 16*a* adds a value obtained by multiplying the basic cosine wave $x_0(n)$ by the real part $c_{01}$ of the transfer characteristics $p_{11}$, to a value obtained by multiplying the basic sine wave $x_1(n)$ by the imaginary part $c_{11}$ of the transfer characteristics $p_{11}$, and outputs a value obtained by the addition as the reference signal $r_{01}(n)$. In addition, the reference signal generating unit 16*a* delays the reference signal $r_{01}(n)$ by "π/2", and outputs the delayed signal as the reference signal $r_{11}(n)$. Similarly, the reference signal generating unit 16*b* adds a value obtained by multiplying the basic cosine wave $x_0(n)$ by the real part $c_{02}$ of the transfer characteristics $p_{12}$, to a value obtained by multiplying the basic sine wave $x_1(n)$ by the imaginary part $c_{12}$ of the transfer characteristics $p_{12}$, and outputs a value obtained by the addition as the reference signal $r_{02}(n)$. In addition, the reference signal generating unit 16*b* delays the reference signal $r_{02}(n)$ by "π/2", and outputs the delayed signal as the reference signal $r_{12}(n)$. Thus, the reference signal generating units 16*a* and 16*b* correspond to an example of the reference signal generating unit.

The w-updating units 17*a* and 17*b* update the filter coefficients used by the adaptive notch filters 15*a* and 15*b* based on the LMS (Least Mean Square) algorism, and supply the adaptive notch filters 15*a* and 15*b* with the updated filter coefficients. Basically, the w-updating units 17*a* and 17*b* update the filter coefficients used by the adaptive notch filters 15*a* and 15*b* last time so as to minimize the error signal e(n), based on the error signal e(n) and the reference signals $r_{01}(n)$, $r_{11}(n)$, $r_{02}(n)$ and $r_{12}(n)$. Thus, the w-updating units 17*a* and 17*b* correspond to an example of the filter coefficient updating unit.

The filter coefficients before the update of the w-updating unit 17*a* are expressed as "$w_{01}(n)$" and "$w_{11}(n)$", and the filter coefficients after the update of the w-updating unit 17*a* are expressed as "$w_{01}(n+1)$" and "$w_{11}(n+1)$". As shown by equations (5) and (6), the filter coefficients after the update $w_{01}(n+1)$ and $w_{11}(n+1)$ are calculated.

$$w_{01}(n+1)=w_{01}(n)-\mu\cdot e(n)\cdot r_{01}(n) \tag{5}$$

$$w_{11}(n+1)=w_{11}(n)-\mu\cdot e(n)\cdot r_{11}(n) \tag{6}$$

Similarly, the filter coefficients before the update of the w-updating unit 17*b* are expressed as "$w_{02}(n)$" and "$w_{12}(n)$", and the filter coefficients after the update of the w-updating unit 17*b* are expressed as "$w_{02}(n+1)$" and "$w_{12}(n+1)$". As shown by equations (7) and (8), the filter coefficients after the update $w_{02}(n+1)$ and $w_{12}(n+1)$ are calculated.

$$w_{02}(n+1)=w_{02}(n)-\mu\cdot e(n)\cdot r_{02}(n) \tag{7}$$

$$w_{12}(n+1)=w_{12}(n)-\mu\cdot e(n)\cdot r_{12}(n) \tag{8}$$

In equations (5) to (8), "μ" is the step-size parameter. The step-size parameter μ is a coefficient for determining convergence speed. In other words, the step-size parameter μ is a coefficient related to an update rate of the filter coefficient w. Concretely, the larger the step-size parameter μ becomes, the higher the update rate of the filter coefficient w becomes. In other words, the smaller the step-size parameter μ becomes, the lower the update rate of the filter coefficient w becomes.

The μ changing units 21*a* and 21*b* change the step-size parameter μ used by the w-updating units 17*a* and 17*b*. Concretely, the μ changing units 21*a* and 21*b* change the step-size parameter μ based on the similarity degree between the characteristics of the engine noise and the transfer characteristics from each of the speakers 10*a* and 10*b* to the microphone 11. The detail of a method for changing the step-size parameter μ will be described later. When the μ changing unit 21 changes the step-size parameter μ, the w-updating unit 17 uses the changed value. When the μ changing unit 21 does not change the step-size parameter μ, the w-updating unit 17 uses the original value. Hereinafter, the original value of the step-size parameter μ is expressed as "basic step-size parameter μ", and the value which is obtained by changing the basic step-size parameter μ is expressed as "changed step-size parameter μ'". For example, a value which is preliminarily set based on an experiment is used as the basic step-size parameter μ. Thus, the μ changing units 21*a* and 21*b* correspond to an example of the controlling unit (specifically, the step-size parameter changing unit).

(Step-Size Parameter Changing Method)

Here, a concrete description will be given of a step-size parameter μ changing method in the first embodiment. The first embodiment uses the similarity degree between the characteristics of the engine noise and the transfer characteristics from each of the speakers 10*a* and 10*b* to the microphone 11. Then, as for the speaker 10 which is the higher of the speakers 10*a* and 10*b*, the first embodiment does not change the step-size parameter μ. Namely, as for the speaker 10 which is the higher of the speakers 10*a* and 10*b*, the first embodiment uses the basic step-size parameter μ. Meanwhile, as for the speaker 10 which is the lower of the speakers 10*a* and 10*b*, the first embodiment changes the step-size parameter μ. Namely, as for the speaker 10 which is the lower of the speakers 10*a* and 10*b*, the first embodiment uses the changed step-size parameter μ'. Concretely, as for the speaker 10 which is the lower of the speakers 10*a* and 10*b*, the first embodiment uses "0" as the changed step-size parameter μ'. When "0" is used as the changed step-size parameter μ', since an initial value of the filter coefficient w is "0", the speaker 10 using the changed step-size parameter μ' (i.e., the speaker 10 having such transfer characteristics that the similarity degree is low) does not generate the control sound. Meanwhile, when the basic step-size parameter μ is used, the speaker 10 (i.e., the speaker 10 having such transfer characteristics that the similarity degree is high) generates the control sound corresponding to the control signal generated by using the filter coefficient w updated by the basic step-size parameter μ in the adaptive notch filter 15.

However, there is a tendency that the similarity degree between the characteristics of the engine noise and the transfer characteristics from the speaker 10 to the microphone 11 is changed in accordance with a frequency of the engine noise. Therefore, the speaker 10 for which the step-size parameter μ is changed may be switched in accordance with the frequency of the engine noise. For example, the first embodiment can switch between the speaker 10 using the basic step-size parameter μ and the speaker 10 using the changed step-size parameter μ', in accordance with the frequency of the engine noise.

Additionally, the first embodiment uses normalized cross-correlation between gain characteristics from the speaker 10 to the microphone 11 and sound pressure characteristics of the engine noise, as the similarity degree between the transfer characteristics from the speaker 10 to the microphone 11 and the characteristics of the engine noise. The normalized cross-correlation can be calculated by publicly known methods. However, it is not limited to calculate the similarity degree by the normalized cross-correlation. The similarity degree may be calculated by publicly known methods other than the normalized cross-correlation (The same will apply hereinafter).

Additionally, only when the frequency of the engine noise is within a frequency band (hereinafter referred to as "dip band") in which the dip of the characteristics of the engine noise occurs, the first embodiment changes the step-size parameter μ. Namely, when the frequency of the engine noise is not within the dip band, the first embodiment does not change the step-size parameter μ, i.e., the first embodiment uses the basic step-size parameter μ. The dip band is the frequency band in which the gain of the engine noise decreases to less than or equal to a predetermined value as shown in FIG. 3A, for example. A band which is determined by a preliminary measurement of the engine noise is used as the dip band. Though FIG. 3A shows a case that only one dip band exists, there is a case that two or more dip bands exist. In this case, two or more dip bands are determined.

The μ changing unit 21 preliminarily stores the dip band determined by the above method. Concretely, the μ changing unit 21 stores a table in which one or more dip bands are associated with the changed step-size parameter μ' (=0). Specifically, since there is a tendency that the similarity degree between the characteristics of the engine noise and the transfer characteristics from the speaker 10 to the microphone 11 is changed in accordance with the frequency of the engine noise, information related to the speaker 10 using the changed step-size parameter μ' for each dip band is stored in the table, when the two or more dip bands exist. By referring to the above table, as for the speaker 10 for which the changed step-size parameter μ' should be used within the dip band, the μ changing units 21*a* and 21*b* change the basic step-size parameter μ to the changed step-size parameter μ' (=0), when the frequency of the engine noise is within the stored dip band.

(Operation and Effect of First Embodiment)

Next, a description will be given of an operation and an effect by the first embodiment, with reference to FIG. 5A to FIG. 7B.

Figure 5A:
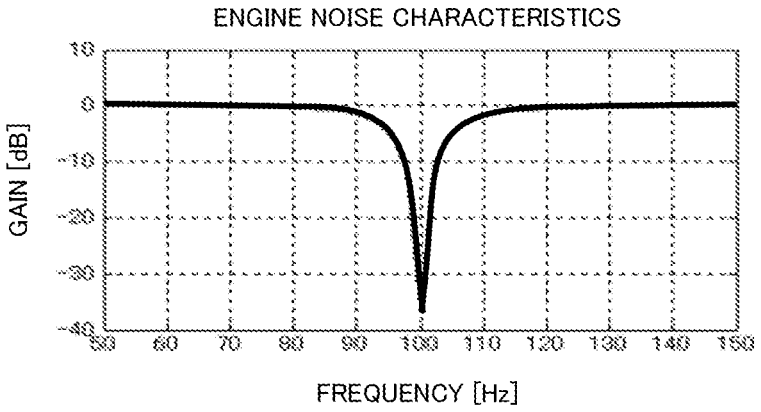
FIGS. 5A to 5C show various transfer characteristics as an experiment condition.
Figure 5B:
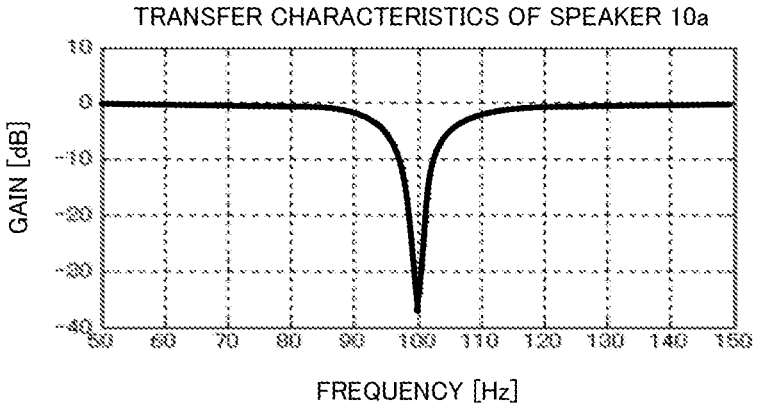
Figure 5C:
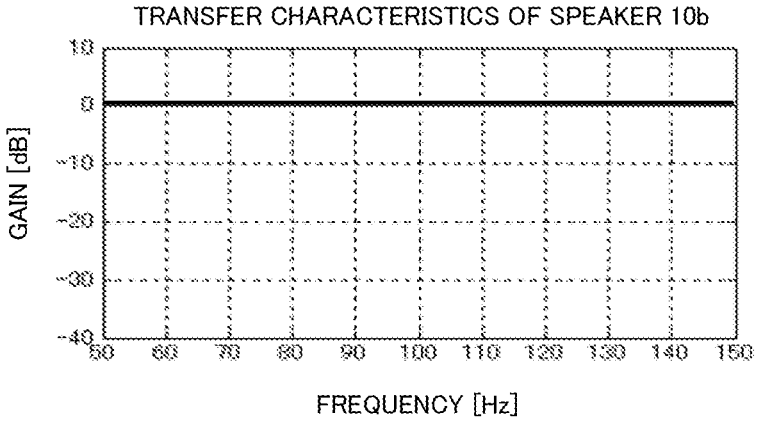

FIGS. 5A to 5C show various transfer characteristics as an experiment condition. FIG. 5A shows characteristics (sound pressure characteristics) of the engine noise, and FIG. 5B shows transfer characteristics (gain characteristics) from the speaker 10*a* to the microphone 11, and FIG. 5C shows transfer characteristics (gain characteristics) from the speaker 10*b* to the microphone 11. As shown in FIGS. 5A to 5C, the similarity degree between the characteristics of the engine noise and the transfer characteristics from the speaker 10*a* to the microphone 11 is higher than the similarity degree between the characteristics of the engine noise and the transfer characteristics from the speaker 10*b* to the microphone 11. In this case, the speaker 10*a* is selected as the speaker 10 which generates the control sound. Namely, only the speaker 10*a* generates the control sound. The speaker 10*b* does not generate the control sound.

Figure 6:
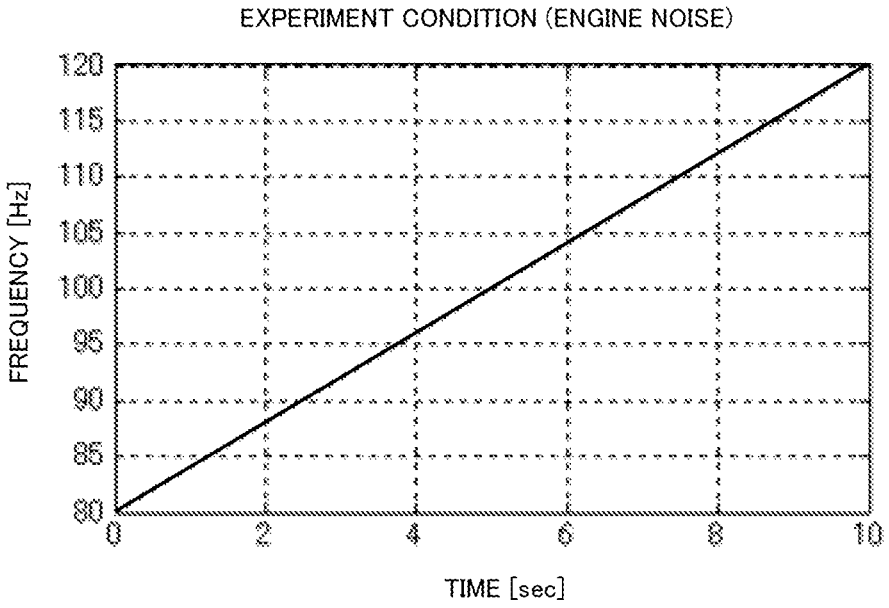
FIG. 6 shows an engine noise used in an experiment.

FIG. 6 shows an engine noise used in an experiment. It is assumed that such an engine noise that the frequency gradually increases as time passes is used in the experiment.

Figure 7A:
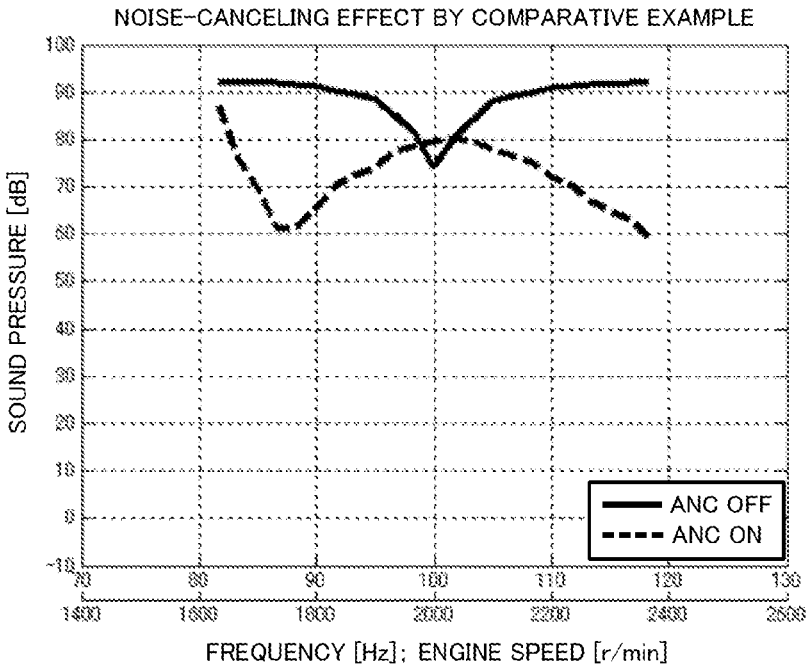
FIGS. 7A and 7B show examples of an operation and an effect by an active vibration noise control device according to a first embodiment.
Figure 7B:
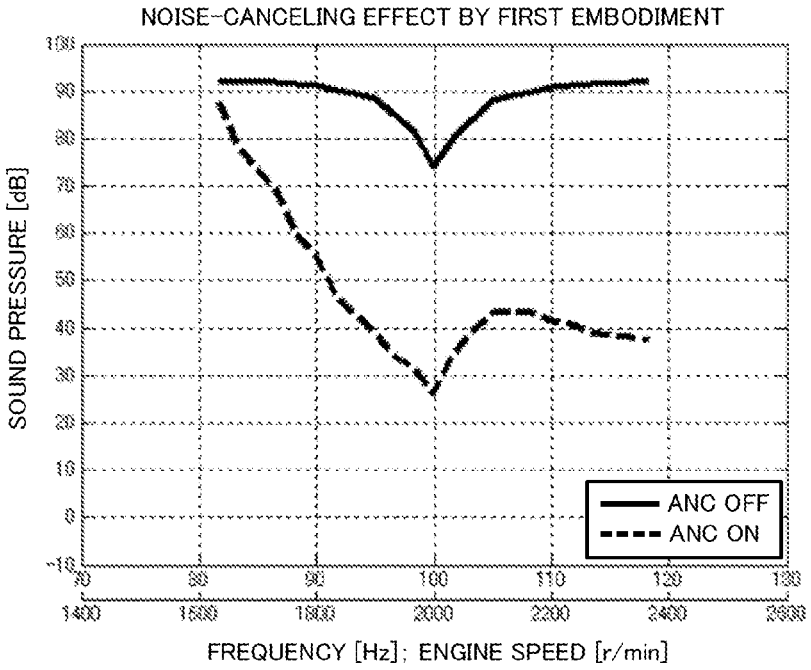

FIGS. 7A and 7B show examples of an operation and an effect by the active vibration noise control device 50 according to the first embodiment. In FIGS. 7A and 7B, a noise-canceling effect by the active vibration noise control device 50 according to the first embodiment is compared with a noise-canceling effect by the active vibration noise control device according to the comparative example. The experiment condition is as shown in FIG. 5A to FIG. 6.

In FIGS. 7A and 7B, a horizontal axis shows an engine frequency and engine speed, and a vertical axis shows a sound pressure detected by the microphone 11. Additionally, a solid line shows a graph obtained when the active noise control is not performed (ANC OFF), and a broken line shows a graph obtained when the active noise control is performed (ANC ON).

FIG. 7A shows the noise-canceling effect by the active vibration noise control device according to the comparative example. FIG. 7A is the same as FIG. 3D. FIG. 7B shows the noise-canceling effect by the active vibration noise control device 50 according to the first embodiment. As shown in FIGS. 7A and 7B, it can be understood that the active vibration noise control device 50 according to the first embodiment can appropriately cancel the engine noise compared to the active vibration noise control device according to the comparative example. For example, it can be understood that the decrease in the noise-canceled amount is improved within the dip band.

Figure 8A:
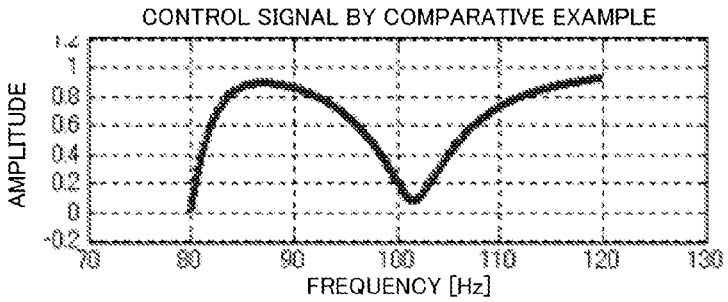
FIGS. 8A to 8D show examples of a control signal of an active vibration noise control device according to a first embodiment.
Figure 8B:
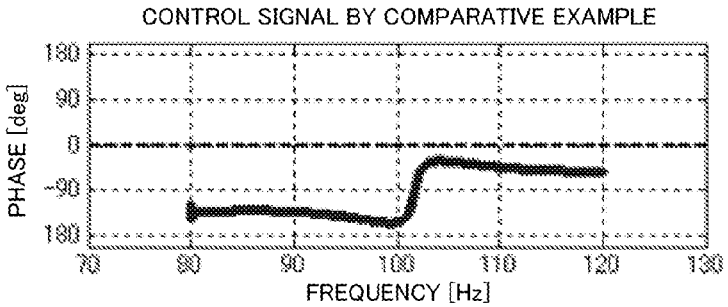
Figure 8C:
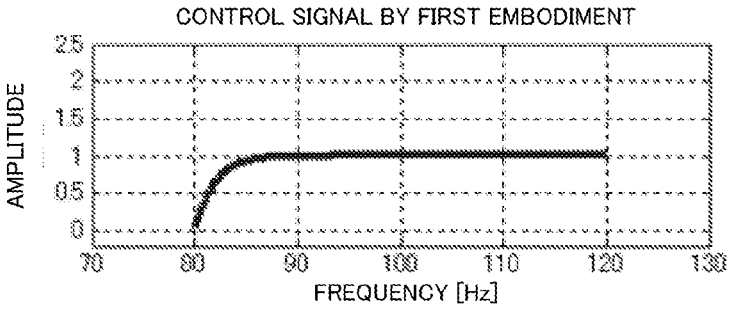
Figure 8D:
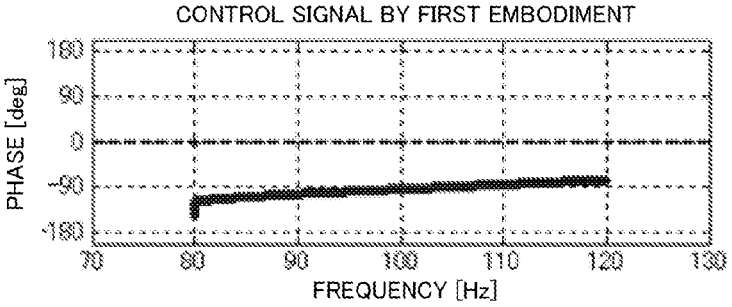

A description will be given of the reason that the decrease in the noise-canceled amount is improved, with reference to FIGS. 8A to 8D. FIGS. 8A and 8B show examples of frequency characteristics of the control signal by the active vibration noise control device according to the comparative example. As shown in FIGS. 8A and 8B, it can be understood that a rapid characteristics change is needed in a frequency band near the dip band of 100 [Hz]. Meanwhile, FIGS. 8C and 8D show examples of frequency characteristics of the control signal by the active vibration noise control device 50 according to the first embodiment. As shown in FIGS. 8C and 8D, since the vibration noise is similar to the transfer characteristics of the speaker, it can be understood that a rapid change of the control signal is not needed. Therefore, by the active vibration noise control device 50 according to the first embodiment, the decrease in the noise-canceled amount is improved compared to the active vibration noise control device according to the comparative example.

Thus, by the active vibration noise control device 50 according to the first embodiment, since the speaker 10 which generates the control sound is selected based on the similarity degree between the transfer characteristics from the speaker 10 to the microphone 11 and the characteristics of the engine noise, it is possible to appropriately ensure the noise-canceling effect regardless of the characteristics of the engine noise.

Second Embodiment

Next, a description will be given of a second embodiment. The above first embodiment does not change the step-size parameter μ related to the speaker 10 having such transfer characteristics that the similarity degree is highest, and changes the step-size parameter μ related to the other speaker 10, to "0". However, the second embodiment makes the step-size parameter μ larger as the similarity degree between the transfer characteristics from the speaker 10 to the microphone 11 and the characteristics of the engine noise becomes higher, and the second embodiment makes the step-size parameter μ smaller as the similarity degree becomes lower. Namely, though the first embodiment simply makes either the speaker 10*a* or the speaker 10*b* generate the control sound based on the similarity degree, the second embodiment basically makes both the speaker 10*a* and the speaker 10*b* generate the control sound, and changes amplitude of the control signals used by each of the speakers 10*a* and 10*b*, based on the similarity degree. Specifically, the second embodiment uses a coefficient (hereinafter referred to as "change magnification K") for weighting the basic step-size parameter μ, and set the change magnification K based on the similarity degree. Then, the second embodiment continuously changes the basic step-size parameter μ by the change magnification K.

It is assumed that the control according to the second embodiment is performed by the active vibration noise control device 50 shown in the above first embodiment, too. Hereinafter, the same reference numerals are given to the same components as those of the first embodiment, and explanations thereof are omitted. In addition, the components and processes which are not especially explained are the same as those of the first embodiment.

In the second embodiment, as shown by an equation (9), the μ changing units 21*a* and 21*b* multiply the basic step-size parameter μ by the change magnification K so as to calculate the changed step-size parameter μ'.

$$\mu' = \mu \cdot K \tag{9}$$

The change magnification K is determined based on the similarity degree between the characteristics of the engine noise and the transfer characteristics from each of the speakers 10*a* and 10*b* to the microphone 11. The μ changing units 21*a* and 21*b* use different values as the change magnification K. Basically, the higher the similarity degree becomes, the larger the change magnification K becomes. In other words, the lower the similarity degree becomes, the smaller the change magnification K becomes. Therefore, the higher the similarity degree becomes, the larger the changed step-size parameter μ' becomes. Namely, the lower the similarity degree becomes, the smaller the changed step-size parameter μ' becomes.

Here, a description will be given of a concrete example of a method for calculating the change magnification K. First, the similarity degree COa between the sound pressure characteristics of the engine noise and the gain characteristics from the speaker 10*a* to the microphone 11 and the similarity degree COb between the sound pressure characteristics of the engine noise and the gain characteristics from the speaker 10*b* to the microphone 11 are calculated by the normalized cross-correlation. Hereinafter, when the similarity degree COa is not distinguished from the similarity degree COb, the similarity degrees COa and Cob are represented as "COx". Next, an average value COav of the similarity degrees COa and Cob is calculated. Next, a determination as to whether each of the similarity degrees COa and Cob is larger or smaller than the average value COav is performed. Next, a weighting ratio R indicating a degree for reflecting the similarity degree in the step-size parameter μ is determined. Next, based on the similarity degrees COa and Cob, the average value COav and the weighting ratio R, the change magnification K is calculated. Concretely, when the similarity degree COx is larger than or equal to the average value COav, the change magnification K is calculated by an equation (10). Meanwhile, when the similarity degree COx is smaller than the average value COav, the change magnification K is calculated by an equation (11).

$$K = R \cdot |COx - COav| \tag{10}$$

$$K = 1/(R \cdot |COx - COav|) \tag{11}$$

For example, it is assumed that the similarity degree COa calculated by the normalized cross-correlation is "1.0", and that the similarity degree COb calculated by the normalized cross-correlation is "0.63". In the example, since the average value COav of the similarity degrees COa and Cob is "0.815", the similarity degree COa is larger than the average value COav, and the similarity degree COb is smaller than the average value COav. Additionally, "173" is used as the weighting ratio R. Thus, by the equation (10), the change magnification K (hereinafter suitably referred to as "Ka") used by the speaker 10*a* is "Ka=173·|1−0.815|≈32". Meanwhile, by the equation (11), the change magnification K (hereinafter suitably referred to as "Kb") used by the speaker 10*b* is "Kb=1/(173·|0.63−0.815|)≈1/32".

It is not necessary to calculate the change magnification K during the control by the active vibration noise control device 50. The change magnification K can be preliminarily calculated by the above method, and the μ changing unit 21 can store the change magnification K which is preliminarily calculated. Concretely, as mentioned in the first embodiment, the μ changing unit 21 can preliminarily store a table in which the change magnification K is associated with the frequency. Specifically, the μ changing unit 21 stores the table in which one or more dip bands are associated with the change magnifications K which should be used in each dip bands. Then, by referring to the above table, when the frequency of the engine noise is within the stored dip band, the μ changing unit 21 uses the change magnification K associated with the said dip band, and changes the basic step-size parameter μ to the changed step-size parameter μ'. However, without storing the change magnification Kin the table, the changed step-size parameter μ' calculated by the change magnification K may be stored in the table.

Figure 9A:
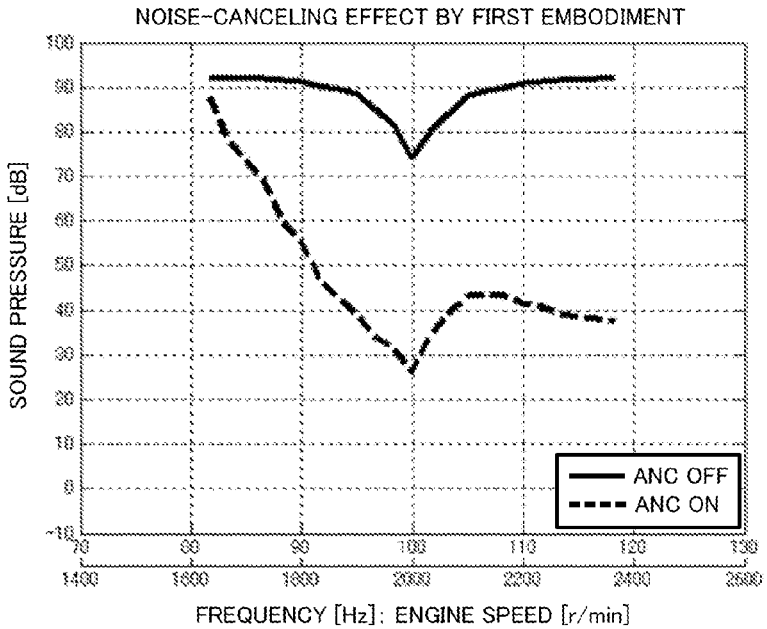
FIGS. 9A and 9B show examples of an operation and an effect by an active vibration noise control device according to a second embodiment.
Figure 9B:
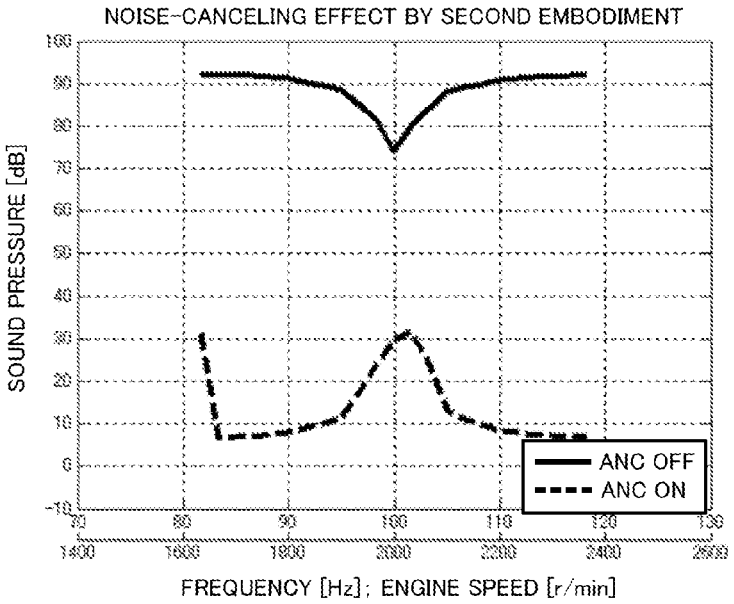

Next, a description will be given of an operation and an effect by the second embodiment, with reference to FIGS. 9A and 9B. In FIGS. 9A and 9B, a noise-canceling effect by the active vibration noise control device 50 according to the second embodiment is compared with a noise-canceling effect by the active vibration noise control device 50 according to the first embodiment. The experiment condition is as shown in FIG. 5A to FIG. 6.

In FIGS. 9A and 9B, a horizontal axis shows an engine frequency and engine speed, and a vertical axis shows a sound pressure detected by the microphone 11. Additionally, a solid line shows a graph obtained when the active noise control is not performed (ANC OFF), and a broken line shows a graph obtained when the active noise control is performed (ANC ON).

FIG. 9A shows the noise-canceling effect by the active vibration noise control device 50 according to the first embodiment. FIG. 9A is the same as FIG. 7B. FIG. 9B shows the noise-canceling effect by the active vibration noise control device 50 according to the second embodiment. As shown in FIGS. 9A and 9B, it can be understood that the active vibration noise control device 50 according to the second embodiment can effectively cancel the engine noise compared to the active vibration noise control device 50 according to the first embodiment.

Figure 10A:
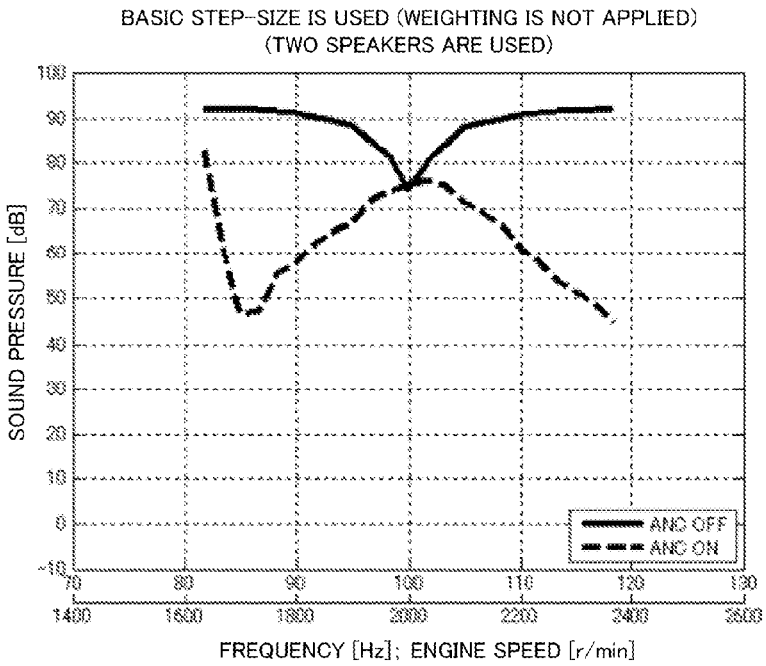
FIGS. 10A and 10B show diagrams for comparing a second embodiment to a case that a basic step-size parameter is used.
Figure 10B:
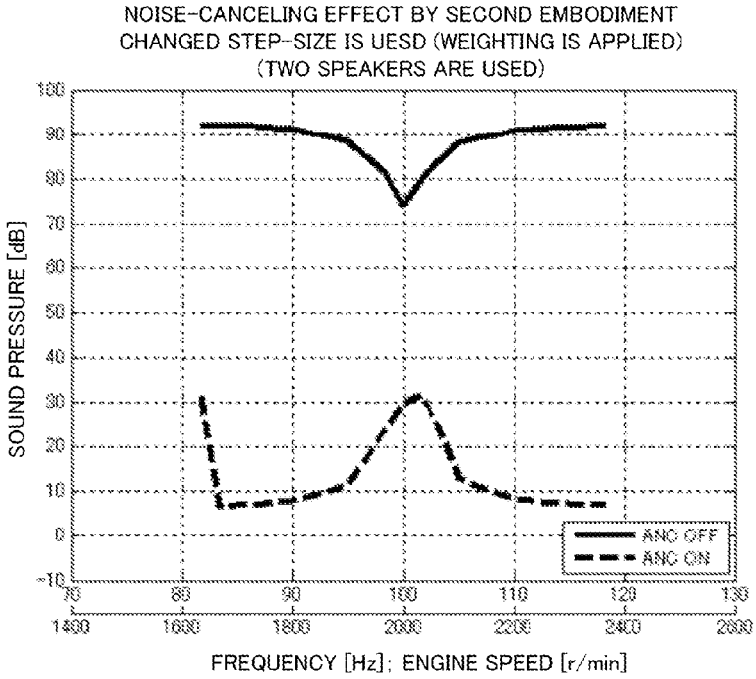

Here, the second embodiment is compared to a case that two speakers are used and the basic step-size parameter μ is used, with reference to FIGS. 10A and 10B. FIG. 10A shows a noise-canceling effect by the case that the basic step-size parameter μ is used, and FIG. 10B shows a noise-canceling effect by the second embodiment. FIG. 10B is the same as FIG. 9B. As shown in FIGS. 10A and 10*b*, it can be understood that the noise-canceling effect of the second embodiment is higher than that of the case that the basic step-size parameter μ is used.

Figure 11A:
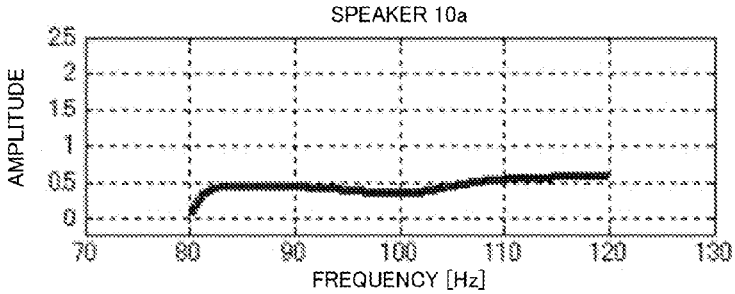
FIGS. 11A to 11D show examples of a control signal in case of using a basic step-size parameter.
Figure 11B:
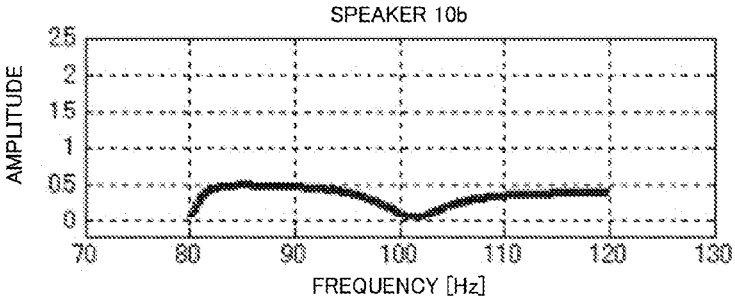
Figure 11C:
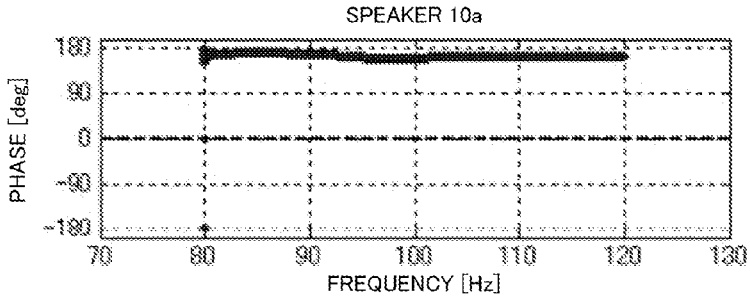
Figure 11D:
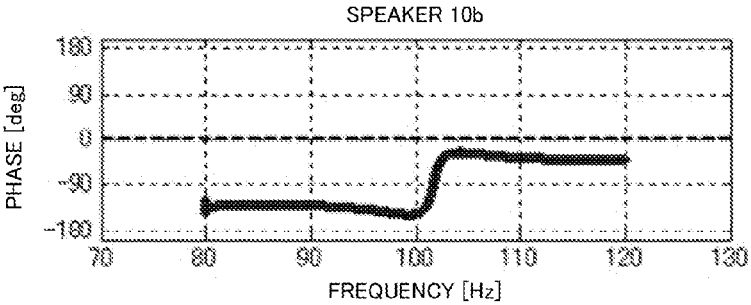
Figure 12A:
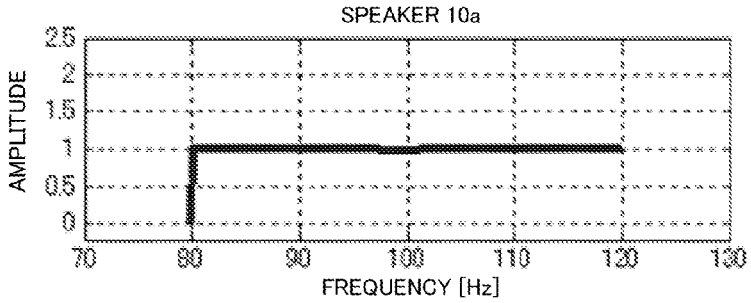
FIGS. 12A to 12D show examples of a control signal by an active vibration noise control device according to a second embodiment.
Figure 12B:
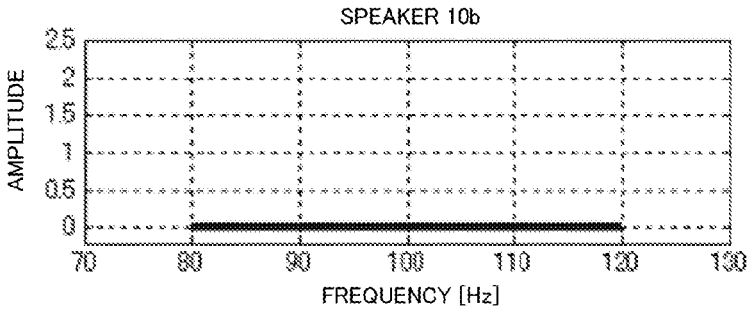
Figure 12C:
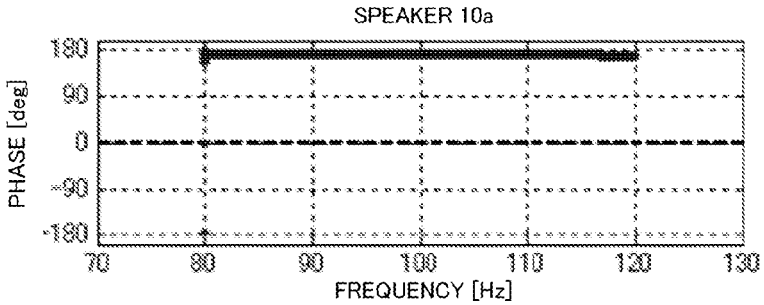
Figure 12D:
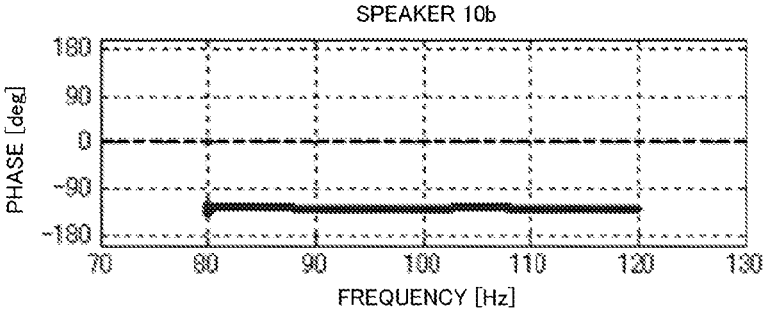

A description will be given of the above reason, with reference to FIG. 11A to FIG. 12D. FIGS. 11A to 11D show examples of the control signal in case of using the basic step-size parameter μ. FIGS. 11A and 11C show examples of the control signal of the speaker 10*a*, and FIGS. 11B and 11D show examples of the control signal of the speaker 10*b*. Meanwhile, FIGS. 12A to 12D show examples of the control signal by the active vibration noise control device 50 according to the second embodiment. FIGS. 12A and 12C show examples of the control signal of the speaker 10*a*, and FIGS. 12B and 12D show examples of the control signal of the speaker 10*b*. As shown in FIGS. 11A to 11D and FIGS. 12A to 12D, it can be understood that the control signal of the second embodiment is stable, and that a rapid change of the control signal is not needed. Additionally, by the second embodiment, it can be understood that the amplitude of such a speaker 10*b* that the similarity degree is low is suppressed. This means that the control sound is effectively generated from the speaker 10*a* having the transfer characteristics which is similar to the characteristics of the engine noise, and that the generation of the control sound from the speaker 10*b* having the transfer characteristics which is less similar to the characteristics of the engine noise is appropriately suppressed. Therefore, by weighting the step-size with respect to the speaker in accordance with the similarity between the characteristics of the engine noise and the transfer characteristics of the speaker, it is possible to obtain the preferable noise-canceling effect.

Thus, by the active vibration noise control device 50 according to the second embodiment, since the step-size parameter is continuously changed based on the similarity degree between the transfer characteristics from the speaker 10 to the microphone 11 and the characteristics of the engine noise, it is possible to certainly ensure the noise-canceling effect regardless of the characteristics of the engine noise.

Third Embodiment

Next, a description will be given of a third embodiment. The first and second embodiments change the step-size parameter μ based on the similarity degree between the transfer characteristics from the speaker 10 to the microphone 11 and the characteristics of the engine noise. Meanwhile, instead of changing the step-size parameter μ, the third embodiment changes a gain for amplifying the control signal used by the speaker 10. Concretely, the third embodiment changes the gain for amplifying the control signal so as to change the amplitude of the control signal of the speaker 10, based on the similarity degree between the transfer characteristics from the speaker 10 to the microphone 11 and the characteristics of the engine noise.

Hereinafter, the same reference numerals are given to the same components as those of the first embodiment, and explanations thereof are omitted. In addition, the components and processes which are not especially explained are the same as those of the first and second embodiments.

Figure 13:
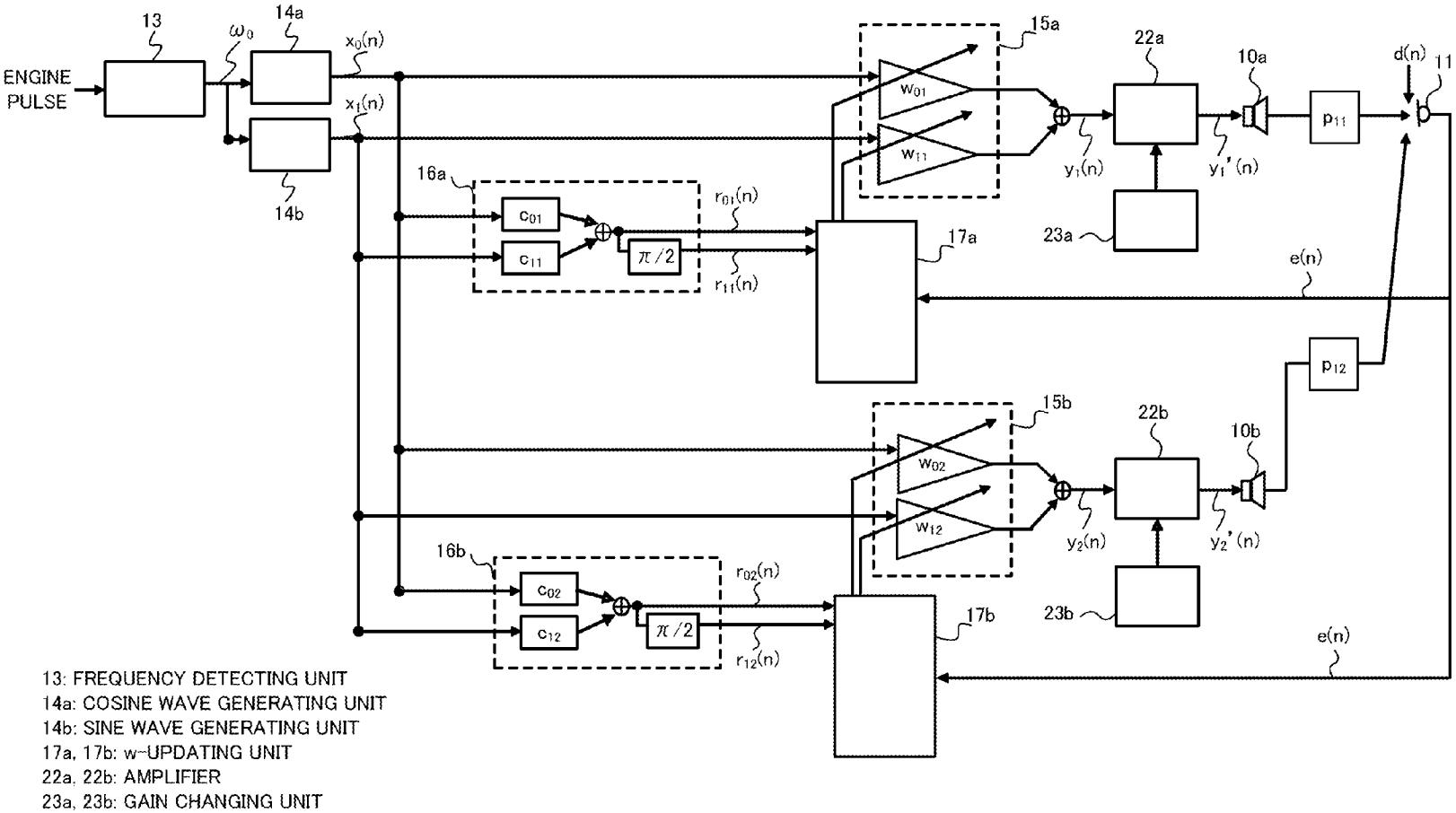
FIG. 13 shows a block diagram of an active vibration noise control device according to a third embodiment.

FIG. 13 is a block diagram showing an example of the configuration of the active vibration noise control device 51 according to the third embodiment. The active vibration noise control device 51 according to the third embodiment is different from the active vibration noise control device 50 according to the first and second embodiments in that amplifiers 22*a* and 22*b* and gain changing units 23*a* and 23*b* are included instead of the μ changing unit 21. Hereinafter, as for the amplifiers 22*a* and 22*b* and the gain changing units 23*a* and 23*b*, "a" and "b" which are applied to the reference numeral are suitably omitted.

The amplifiers 22*a* and 22*b* amplify the control signals $y_1(n)$ and $y_2(n)$ outputted from the adaptive notch filters 15*a* and 15*b*. Concretely, the amplifiers 22*a* and 22*b* multiply the control signals $y_1(n)$ and $y_2(n)$ by gains so as to calculate control signals $y_1'(n)$ and $y_2'(n)$, and output the control signals $y_1'(n)$ and $y_2'(n)$ to the speakers 10*a* and 10*b*.

The gain changing units 23*a* and 23*b* change the gains used by the amplifiers 22*a* and 22*b*. Concretely, the gain changing units 23*a* and 23*b* change the gains based on the similarity degree between the transfer characteristics from each of the speakers 10*a* and 10*b* to the microphone 11 and the characteristics of the engine noise. The amplifier 22 uses the changed value when the gain changing unit 23 changes the gain, and uses the original value when the gain changing unit 23 does not change the gain. Hereinafter, the original value of the gain is expressed as "basic gain", and the value which is obtained by changing the basic gain is expressed as "changed gain". Thus, the amplifiers 22*a* and 22*b* and the gain changing units 23*a* and 23*b* correspond to an example of the controlling unit. Specifically, the gain changing units 23*a* and 23*b* correspond to an example of the gain changing unit.

The gain changing unit 23 changes the gain by the same method as the above first or second embodiment. When the first embodiment is applied, the gain changing unit 23 does not change the gain related to the speaker 10 having such transfer characteristics that the similarity degree between the transfer characteristics from the speaker 10 to the microphone 11 and the characteristics of the engine noise is highest. In this case, the gain changing unit 23 sets the gain to "1", for example. Meanwhile, the gain changing unit 23 changes the gain related to the other speaker 10, to "0". On the other hand, when the second embodiment is applied, the gain changing unit 23 makes the gain larger as the similarity degree between the transfer characteristics from the speaker 10 to the microphone 11 and the characteristics of the engine noise becomes higher, and the gain changing unit 23 makes the gain smaller as the said similarity degree becomes lower. In this case, the gain can be changed by the same method as the second embodiment. Concretely, the gain can be changed by using the change magnification K in the second embodiment.

Similar to the first and second embodiments, the gain which should be used to the frequency can be preliminarily calculated, and the gain changing unit 23 can preliminarily store a table in which the gain is associated with the frequency. Concretely, the gain changing unit 23 stores the table in which one or more dip bands are associated with the gains which should be used in each dip bands. Then, by referring to the above table, when the frequency of the engine noise is within the stored dip band, the gain changing unit 23 changes the basic gain to the changed gain.

By the above active vibration noise control device 51 according to the third embodiment, it is possible to appropriately ensure the noise-canceling effect regardless of the characteristics of the engine noise, too.

Modified Examples

Hereinafter, a description will be given of modified examples related to the above embodiments.

The above embodiments show such an example that the present invention is applied to the system having the two speakers 10*a* and 10*b*. Similarly, the present invention can be applied to a system having three or more speakers, too. For example, when the first embodiment (including the third embodiment) is applied to the system having three or more speakers, as for a speaker having such transfer characteristics that the similarity degree between the transfer characteristics from the speaker to the microphone and the characteristics of the engine noise is highest, the step-size parameter μ or the gain is not changed. As for two or more speakers other than the said speaker, the step-size parameter μ or the gain is changed to "0". Meanwhile, when the second embodiment is applied to the system having three or more speakers, it is not necessary to particularly change the method in the second embodiment.

The above embodiments show such an example that the present invention is applied to the system having only one microphone 11. Similarly, the present invention can be applied to a system having two or more microphones, too. In this case, the similarity degree is defined by transfer characteristics from each of multiple speakers to each of two or more e microphones and the characteristics of the engine noise. Namely, there are as many similarity degrees as combinations of the multiple speakers and the two or more microphones. As an example, an average value of the similarity degrees can be calculated for each speaker, and the calculated average value can be treated as the actually used similarity degree.

The above embodiments show such an example that the similarity degree is calculated based on the gain characteristics from the speaker to the microphone and the sound pressure characteristics of the engine noise. As another example, phase characteristics from the speaker to the microphone can be used instead of the gain characteristics from the speaker to the microphone, and phase characteristics of the engine noise can be used instead of the sound pressure characteristics of the engine noise, in order to calculate the similarity degree. As still another example, the similarity degree can be calculated based on the gain characteristics and the phase characteristics from the speaker to the microphone, and the sound pressure characteristics and the phase characteristics of the engine noise. Thus, the gain characteristics and/or the phase characteristics can be used as the transfer characteristics from the speaker to the microphone, and the sound pressure characteristics and/or the phase characteristics can be used as the characteristics of the engine noise. The transfer characteristics from the speaker 10 to the microphone 11 correspond to "C hat characteristics" stored in the reference signal generating unit 16 (for example, "$c_{01}$", "$c_{11}$", "$c_{02}$" and "$c_{12}$" in FIG. 4).

The above embodiments show such an example that the step-size parameter μ or the gain is changed only when the frequency of the engine noise is within the dip band. As another example, the step-size parameter μ or the gain can be changed within entire frequency band of the engine noise, based on the similarity degree between the transfer characteristics from the speaker to the microphone and the characteristics of the vibration noise. In this case, since there is a tendency that the similarity degree is changed in accordance with the frequency of the engine noise, a mode for changing the step-size parameter μ or the gain can be changed in accordance with the frequency of the engine noise.

While the present invention is applied to the vehicle in the above description, the application of the present invention is not limited to this. The present invention may be applied to various movable bodies such as a ship, a helicopter and an airplane other than the vehicle.

INDUSTRIAL APPLICABILITY

This invention is applied to closed spaces such as an interior of transportation having a vibration noise source (for example, engine), and can be used for actively controlling a vibration noise.

DESCRIPTION OF REFERENCE NUMBERS

10*a*, 10*b* Speaker
11 Microphone
13 Frequency Detecting Unit
14*a* Cosine Wave Generating Unit
14*b* Sine Wave Generating Unit
15*a*, 15*b* Adaptive Notch Filter
16*a*, 16*b* Reference Signal Generating Unit
17*a*, 17*b* w-Updating Unit
21*a*, 21*b* μ Changing Unit
22*a*, 22*b* Amplifier
23*a*, 23*b* Gain Changing Unit
50, 51 Active Vibration Noise Control Device

The invention claimed is:

1. An active vibration noise control device which obtains error signals corresponding to a cancellation error between a vibration noise and control sounds generated by multiple speakers, from at least one or more microphones, and which actively controls the vibration noise, comprising:

a basic signal generating unit which generates a basic signal based on a vibration noise frequency of the vibration noise;

an adaptive notch filter unit which generates control signals provided to each of the multiple speakers by applying a filter coefficient to the basic signal, in order to make the multiple speakers generate the control sounds so that the vibration noise is canceled;

a reference signal generating unit which generates a reference signal from the basic signal based on multiple transfer characteristics from the multiple speakers to the one or more microphones;

a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a highest similarity degree between each of the multiple transfer characteristics and characteristics of the vibration noise.

2. The active vibration noise control device according to claim 1, wherein, as the similarity degree becomes higher, the controlling unit makes the amplitude of the control signals larger.

3. The active vibration noise control device according to claim 2, wherein the controlling unit includes a step-size parameter changing unit which changes the amplitude of the control signals by changing a step-size parameter used for updating the filter coefficient in the filter coefficient updating unit, based on the similarity degree.

4. The active vibration noise control device according to claim 2, wherein the controlling unit includes an amplifying unit which amplifies the control signals generated by the adaptive notch filter unit, and outputs the amplified control signals to the multiple speakers, and wherein the controlling unit includes a gain changing unit which changes the amplitude of the control signals by changing a gain used by the amplifying unit, based on the similarity degree.

5. The active vibration noise control device according to claim 2, wherein, only when the vibration noise frequency is within a frequency band in which a dip of the vibration noise occurs, the controlling unit changes the amplitude of the control signals, and wherein, when the vibration noise frequency is not within the frequency band, the controlling unit does not change the amplitude of the control signals.

6. The active vibration noise control device according to claim 1, wherein the controlling unit includes a step-size parameter changing unit which changes the amplitude of the control signals by changing a step-size parameter used for updating the filter coefficient in the filter coefficient updating unit, based on the similarity degree.

7. The active vibration noise control device according to claim 6, wherein, as for a speaker having such transfer characteristics that the similarity degree is highest in the multiple transfer characteristics, the step-size parameter changing unit does not change the step-size parameter for updating the filter coefficient used by the adaptive notch filter unit which generates the control signal of the said speaker, and wherein, as for one or more speakers other than the speaker having such transfer characteristics that the similarity degree is highest, the step-size parameter changing unit changes the step-size parameter for updating the filter coefficient used by the adaptive notch filter unit which generates the control signals of the said one or more speakers, to "0".

8. The active vibration noise control device according to claim 7, wherein, only when the vibration noise frequency is within a frequency band in which a dip of the vibration noise occurs, the controlling unit changes the amplitude of the control signals, and wherein, when the vibration noise frequency is not within the frequency band, the controlling unit does not change the amplitude of the control signals.

9. The active vibration noise control device according to claim 6, wherein, as the similarity degree becomes higher, the step-size parameter changing unit makes the step-size parameter larger, and wherein, as the similarity degree becomes lower, the step-size parameter changing unit makes the step-size parameter smaller.

10. The active vibration noise control device according to claim 9, wherein, only when the vibration noise frequency is within a frequency band in which a dip of the vibration noise occurs, the controlling unit changes the amplitude of the control signals, and wherein, when the vibration noise frequency is not within the frequency band, the controlling unit does not change the amplitude of the control signals.

11. The active vibration noise control device according to claim 6, wherein, only when the vibration noise frequency is within a frequency band in which a dip of the vibration noise occurs, the controlling unit changes the amplitude of the control signals, and wherein, when the vibration noise frequency is not within the frequency band, the controlling unit does not change the amplitude of the control signals.

12. The active vibration noise control device according to claim 1, wherein the controlling unit includes an amplifying unit which amplifies the control signals generated by the adaptive notch filter unit, and outputs the amplified control signals to the multiple speakers, and wherein the controlling unit includes a gain changing unit which changes the amplitude of the control signals by changing a gain used by the amplifying unit, based on the similarity degree.

13. The active vibration noise control device according to claim 12, wherein, as for a speaker having such transfer characteristics that the similarity degree is highest in the multiple transfer characteristics, the gain changing unit does not change the gain used by the amplifying unit which amplifies the control signal of the said speaker, and wherein, as for one or more speakers other than the speaker having such transfer characteristics that the similarity degree is highest, the gain changing unit changes the gain used by the amplifying unit which amplifies the control signals of the said one or more speakers, to "0".

14. The active vibration noise control device according to claim 12, wherein, as the similarity degree becomes higher, the gain changing unit makes the step-size parameter larger, and wherein, as the similarity degree becomes lower, the gain changing unit makes the step-size parameter smaller.

15. The active vibration noise control device according to claim 1, wherein, only when the vibration noise frequency is within a frequency band in which a dip of the vibration noise occurs, the controlling unit changes the amplitude of the control signals, and wherein, when the vibration noise frequency is not within the frequency band, the controlling unit does not change the amplitude of the control signals.

16. The active vibration noise control device according to claim 1, wherein the similarity degree is defined based on gain characteristics of the multiple transfer characteristics and sound pressure characteristics of the vibration noise.

17. The active vibration noise control device according to claim 1, wherein the similarity degree is defined based on phase characteristics of the multiple transfer characteristics and phase characteristics of the vibration noise.

18. The active vibration noise control device according to claim 1, wherein normalized cross-correlation between each of the multiple transfer characteristics and characteristics of the vibration noise is used as the similarity degree.

19. The active vibration noise control device according to claim 1, wherein the controlling unit changes the amplitude of the control signals of the multiple speakers based on the similarity degree between each of the multiple transfer characteristics and predetermined characteristics of the vibration noise.

20. An active vibration noise control method executed by a device which obtains error signals corresponding to a cancellation error between a vibration noise and control sounds generated by multiple speakers, from at least one or more microphones, and which actively controls the vibration noise, comprising:

a basic signal generating process which generates a basic signal based on a vibration noise frequency of the vibration noise;

an adaptive notch filter process which generates control signals provided to each of the multiple speakers by applying a filter coefficient to the basic signal, in order to make the multiple speakers generate the control sounds so that the vibration noise is canceled;

a reference signal generating process which generates a reference signal from the basic signal based on multiple transfer characteristics from the multiple speakers to the one or more microphones;

a filter coefficient updating process which updates the filter coefficient used by the adaptive notch filter process based on the reference signal and the error signals detected by the one or more microphones so as to minimize the error signals; and a controlling process which changes amplitude of the control signals of the multiple speakers based on a highest similarity degree between each of the multiple transfer characteristics and characteristics of the vibration noise.

21. A non-transient tangible computer-readable medium storing an active vibration noise control computer program product executed by a device which obtains error signals corresponding to a cancellation error between a vibration noise and control sounds generated by multiple speakers, from at least one or more microphones, and which actively controls the vibration noise, and which includes a computer, the non-transient tangible computer-readable medium causing the computer to function as:

a basic signal generating unit which generates a basic signal based on a vibration noise frequency of the vibration noise;

an adaptive notch filter unit which generates control signals provided to each of the multiple speakers by applying a filter coefficient to the basic signal, in order to make the multiple speakers generate the control sounds so that the vibration noise is canceled;

a reference signal generating unit which generates a reference signal from the basic signal based on multiple transfer characteristics from the multiple speakers to the one or more microphones;

a filter coefficient updating unit which updates the filter coefficient used by the adaptive notch filter unit based on the reference signal and the error signals detected by the one or more microphones so as to minimize the error signals; and a controlling unit which changes amplitude of the control signals of the multiple speakers based on a highest similarity degree between each of the multiple transfer characteristics and characteristics of the vibration noise.

22. The active vibration noise control computer program product according to claim 21, wherein the controlling unit changes the amplitude of the control signals of the multiple speakers based on the similarity degree between each of the multiple transfer characteristics and predetermined characteristics of the vibration noise.

* * * * *